US011107384B2

(12) United States Patent
Kim et al.

(10) Patent No.: US 11,107,384 B2
(45) Date of Patent: Aug. 31, 2021

(54) DISPLAY DRIVING DEVICE INCLUDING VOLTAGE LIMITER FOR SENSING VOLTAGE VARIATION AND LIMITING VOLTAGE LEVEL OF SENSING LINE

(71) Applicant: Silicon Works Co., Ltd., Daejeon (KR)

(72) Inventors: Young Bok Kim, Daejeon (KR); Won Kim, Daejeon (KR)

(73) Assignee: Silicon Works Co., Ltd., Daejeon (KR)

( * ) Notice: Subject to any disclaimer, the term of this patent is extended or adjusted under 35 U.S.C. 154(b) by 0 days.

(21) Appl. No.: 16/851,860

(22) Filed: Apr. 17, 2020

(65) Prior Publication Data

US 2020/0335024 A1 Oct. 22, 2020

(30) Foreign Application Priority Data

Apr. 19, 2019 (KR) ..... 10-2019-0046154
Apr. 16, 2020 (KR) ..... 10-2020-0046158

(51) Int. Cl.
*G09G 3/20* (2006.01)

(52) U.S. Cl.
CPC ..... *G09G 3/20* (2013.01); *G09G 2300/0814* (2013.01); *G09G 2310/0289* (2013.01)

(58) Field of Classification Search
CPC .... G09G 3/20; G09G 2330/08; G09G 3/3648; G09G 2300/0814; G09G 2320/045; G09G 3/3225; G09G 2320/0295; G09G 2310/0289
See application file for complete search history.

(56) References Cited

U.S. PATENT DOCUMENTS

2006/0087254 A1* 4/2006 Yang ..... H05B 41/2822 315/247
2010/0090932 A1* 4/2010 Kim ..... G09G 3/3258 345/76
2019/0326751 A1* 10/2019 Xi ..... H02H 9/046
2020/0168154 A1* 5/2020 Cheng ..... G09G 3/006

FOREIGN PATENT DOCUMENTS

KR 2015-0002131 A 6/2015
KR 2018-0118855 A 11/2018
KR 2020-0005347 A 1/2020
KR 2020-0016039 A 2/2020

* cited by examiner

*Primary Examiner* — Kwang-Su Yang
(74) *Attorney, Agent, or Firm* — Polsinelli PC

(57) ABSTRACT

A display driving device includes sensing lines configured to sense pixel signals of a display panel; and a voltage limiter provided for each of the sensing lines. The voltage limiter senses a voltage variation of the sensing line, and limits a voltage level of the sensing line to a reference voltage.

7 Claims, 2 Drawing Sheets

DISPLAY DRIVING DEVICE INCLUDING VOLTAGE LIMITER FOR SENSING VOLTAGE VARIATION AND LIMITING VOLTAGE LEVEL OF SENSING LINE

BACKGROUND

1. Technical Field

Various embodiments generally relate to a display device, and more particularly, to a display driving device which senses a pixel signal of a display panel.

2. Related Art

In general, a display device includes a display panel, a display driving device, and a timing controller. The display driving device converts digital image data into a source driving signal, and provides the source driving signal to the display panel.

The display panel may have non-uniform characteristics among pixels, depending on a degree of degradation. In order to compensate for such characteristic deviation among the pixels, the display driving device senses pixel signals, converts the pixel signals into pixel data as digital signals, and provides the pixel data to the timing controller.

However, in the related art, when an overcurrent larger than a pixel current of a normal channel flows due to a defect in a certain pixel of the display panel, a voltage variation in the input and output of a current-voltage converter abruptly increases, and thus, a data value of an adjacent normal channel may be affected by a parasitic capacitor between channels.

Therefore, in the related art, there is a problem in that a good result in terms of image quality may not be obtained because the compensation for the characteristic deviation among the pixels is not normally performed due to the influence of a bad channel on the data of the normal channel.

SUMMARY

Various embodiments are directed to a display driving device capable of minimizing the influence of a bad pixel on sensing data of a normal channel by limiting an abrupt voltage variation due to an overcurrent having occurred in the bad pixel.

In an embodiment, a display driving device may include: sensing lines configured to sense pixel signals of a display panel; and a voltage limiter provided for each of the sensing lines. The voltage limiter may sense a voltage variation of the sensing line, and limits a voltage level of the sensing line to a reference voltage.

According to the embodiments, it is possible to minimize the influence of a bad pixel of a display panel on sensing data of a normal channel by limiting an abrupt voltage variation due to an overcurrent having occurred in the bad pixel.

Also, according to the embodiments, since normal compensation may be anticipated, performance in terms of image quality may be improved.

Further, according to the embodiments, improvement in reliability or productivity may be anticipated by minimizing image quality degradation caused when a small number of bad pixels occur.

DETAILED DESCRIPTION

Figure 1:
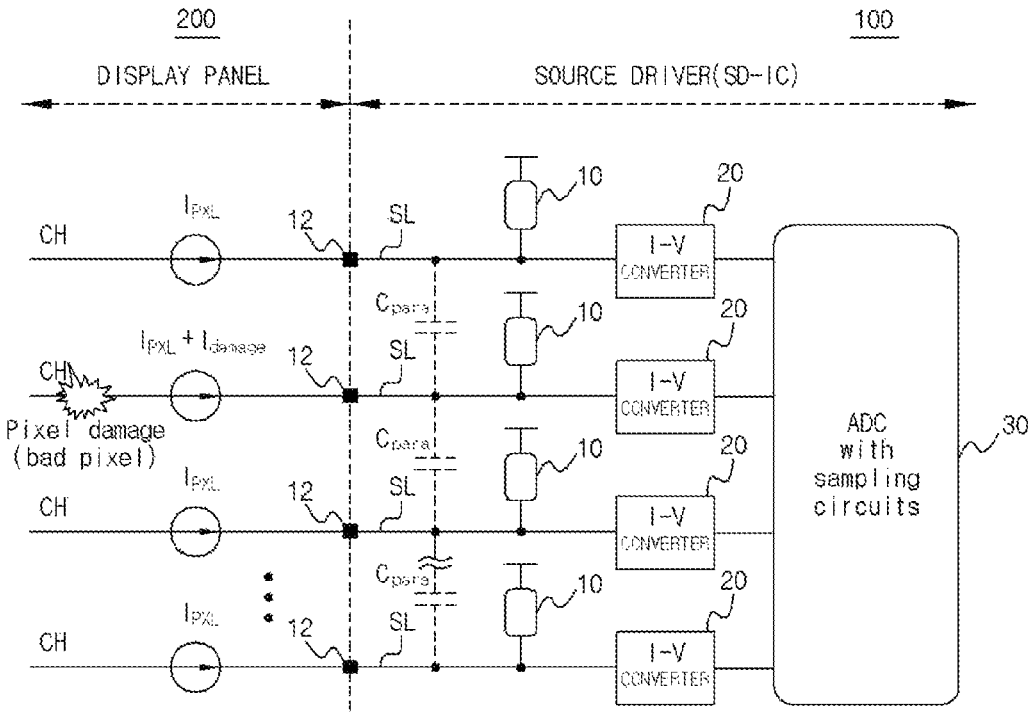
FIG. 1 is a block diagram illustrating a representation of an example of a display driving device in accordance with an embodiment.

Embodiments provide a display driving device capable of minimizing the influence of a bad pixel of a display panel on sensing data of a normal channel by limiting the voltage variation of the corresponding channel when an overcurrent occurs in the bad pixel.

In the embodiments, a reference voltage may be set to a value equal or similar to an initial value of a sensing line before a sensing operation is started.

In the embodiments, a first reference voltage and a second reference voltage may be set as threshold voltages of diodes.

In the embodiments, an initialization period may be defined as a period for initializing sensing lines to a reference voltage before pixel signals are sensed from the display panel.

While the embodiments illustrate that an overcurrent occurs in a bad pixel, it is to be noted that the embodiments are not limited thereto. The embodiments may limit a voltage level of a sensing line to a reference voltage even in the case where an overcurrent is introduced to the sensing line through a sensing pad by electrostatic discharge.

Hereinafter, embodiments of the disclosure will be described in detail with reference to the accompanying drawings. The terms used herein and in the claims shall not be construed as being limited to general or dictionary meanings and shall be interpreted as the meanings and concepts corresponding to technical aspects of the disclosure.

Embodiments described herein and configurations illustrated in the drawings are preferred embodiments of the disclosure, but do not represent all of the technical features of the disclosure. Thus, there may be various equivalents and modifications that can be made thereto at the time of filing the present application.

FIG. 1 is a block diagram illustrating a representation of an example of a display driving device 100 in accordance with an embodiment.

Referring to FIG. 1, the display driving device 100 in accordance with the embodiment includes a source driver (SD-IC) which provides a source driving signal to a display panel 200. FIG. 1 illustrates a part of the inside of the source driver (SD-IC) for the sake of convenience in explanation. FIG. 1 illustrates components which sense pixel signals from the display panel 200 for external compensation for the display panel 200.

As the display panel 200, a liquid crystal panel, an organic light emitting diode (OLED) panel, or the like may be used.

The display panel 200 may include a pixel array in the form of a matrix. The pixel array may include R (red), G (green) and B (blue) pixels or further include W (white) pixels for improving luminance. Each pixel may include a pixel circuit which supplies a current, corresponding to a source driving signal provided from the display driving device 100, to a light emitting element.

The pixel circuit may include a driving transistor which provides the current, corresponding to the source driving signal, to the light emitting element. Characteristics of the driving transistor such as a threshold voltage and a mobility or a characteristic of the light emitting element such as a threshold voltage may be non-uniform depending on a location of the pixel, or a luminance non-uniformity phenomenon may occur due to a deviation in degradations of the driving transistor and the light emitting element with the lapse of a driving time.

In order to compensate for such characteristics of the pixels, the display driving device 100 may sense pixel signals representing the characteristics of the pixels of the display panel 200, may convert the pixel signals into pixel data as digital signals, and may provide the pixel data to a controller (not illustrated). For example, the display driving device 100 may be configured to sense a current or a voltage as a pixel signal. The embodiment of FIG. 1 illustrates a configuration in which a current is sensed as a pixel signal and is then converted into a voltage.

The pixel signal may be used to calculate characteristics of the driving transistor in the pixel circuit, such as a threshold voltage and a mobility, and a degradation characteristic of the light emitting element such as a threshold voltage. Since a pixel current flowing through the light emitting element varies depending on a threshold voltage and a mobility of the driving transistor and a threshold voltage of the light emitting element, the pixel current may be used in calculating the values of the above-described characteristics of the pixel. Further, the values of the characteristics of the pixel may be used in compensating for digital image data.

In the case where a defect occurs in a pixel of the display panel 200 and an overcurrent $I_{damage}$ flows, sensing data of a normal channel may be affected by a parasitic capacitor $C_{para}$ between a bad channel and the normal channel.

Therefore, the disclosure discloses the display driving device 100 capable of minimizing the influence of a bad channel on sensing data of a normal channel by limiting an abrupt voltage variation due to an overcurrent having occurred in a bad pixel of a display panel.

To this end, the display driving device 100 may include a voltage limiter 10 in each of sensing lines SL for sensing pixel signals of the display panel 200. Such a voltage limiter 10 may sense a voltage variation of a sensing line SL and may limit the voltage variation to a reference voltage.

The display driving device 100 described above may include the voltage limiters 10 and current-voltage converters 20 provided for the sensing lines SL, respectively, and an analog-digital converter 30.

Each sensing line SL as a wiring for sensing a pixel signal of the display panel 200 electrically connects a sensing pad 12 and the current-voltage converter 20. The sensing pad 12 may be a read-out pad for reading a pixel signal from the display panel 200, and the pixel signal may be exemplified as a current $I_{PXL}$ of each pixel.

The current-voltage converter 20 may convert the current $I_{PXL}$, corresponding to the pixel signal transferred through the sensing line SL, into a voltage, and may provide the voltage to the analog-digital converter 30. For example, the current-voltage converter 20 may be configured by an integration circuit which converts a current to a voltage.

The analog-digital converter 30 converts the voltage corresponding to the current $I_{PXL}$ of each pixel into pixel data as a digital signal, and provides the pixel data to a timing controller. For example, the analog-digital converter 30 may include sampling circuits which sample voltages of the respective pixels in a preset order.

The voltage limiter 10 may be provided for each of the sensing lines SL for sensing the pixel signals of sensing channels CH of the display panel 200.

Such a voltage limiter 10 may sense a voltage variation of a sensing line SL and may limit the voltage variation to a reference voltage. The reference voltage may be set to a value equal or similar to an initial value before a sensing operation is started.

For example, in the case where an overcurrent $I_{damage}$ flows through a sensing line SL as a defect occurs in the pixel of a certain channel CH among the channels CH of the display panel 200, the voltage limiter 10 may limit the voltage variation of the sensing line SL to the reference voltage which is set to the value equal or similar to the initial value before the sensing operation is started.

Figure 2:
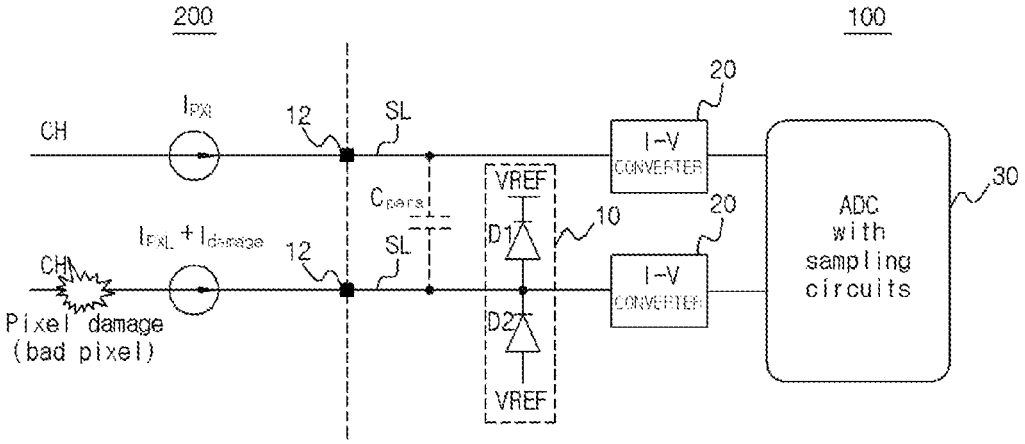
FIG. 2 is a block diagram illustrating a representation of an example of a display driving device in which a voltage limiter of FIG. 1 is configured by diodes, in accordance with an embodiment.

FIG. 2 is a block diagram illustrating a representation of an example of a display driving device in which the voltage limiter 10 of FIG. 1 is configured by diodes, in accordance with an embodiment.

Referring to FIG. 2, the voltage limiter 10 may include a first diode D1 and a second diode D2.

In the first diode D1, an anode terminal may be connected to the sensing line SL, and a cathode terminal may be connected to a reference voltage VREF.

In the second diode D2, a cathode terminal may be connected to the sensing line SL, and an anode terminal may be connected to the reference voltage VREF.

The reference voltage VREF may be set to a value equal or similar to an initial value before a sensing operation is started.

The voltage limiter 10 may limit a voltage variation of the sensing line SL to the reference voltage VREF when the voltage variation of the sensing line SL is larger than the threshold voltages of the first and second diodes D1 and D2.

The display driving device 100 including the voltage limiter 10 in this way may limit, in the case where an overcurrent $I_{damage}$ flows due to a defect having occurred in a pixel of the display panel 200, a voltage level of the sensing line SL to the reference voltage VREF by turning on the first and second diodes D1 and D2.

Therefore, even in the case where an overcurrent flows due to a defect having occurred in a pixel, the display driving device 100 including the voltage limiter 10 described above may minimize an influence exerted on a data value of an adjacent normal channel.

While the embodiments illustrate a case where an overcurrent flows through a sensing line SL due to a defect having occurred in a pixel of the display panel 200, it is to be noted that the embodiments are not limited thereto.

Even in the case where an overcurrent is introduced to the sensing line SL through the sensing pad 12 due to electrostatic discharge, the display driving device 100 according to the embodiment may limit a voltage level of the sensing line SL to the reference voltage VREF by turning on the first and second diodes D1 and D2.

Figure 3:
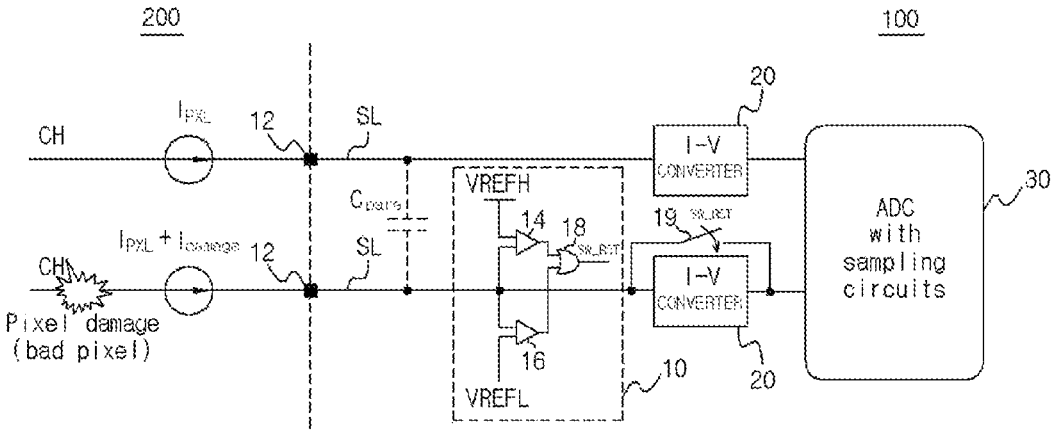
FIG. 3 is a block diagram illustrating a representation of an example of a display driving device in which the voltage limiter of FIG. 1 is configured by comparators, in accordance with an embodiment.

FIG. 3 is a block diagram illustrating a representation of an example of a display driving device 100 in which the voltage limiter 10 of FIG. 1 is configured by comparators, in accordance with an embodiment.

Referring to FIG. 3, the voltage limiter 10 may include a first comparator 14, a second comparator 16, and an operator. For example, the operator may include an OR element 18.

The first comparator 14 compares a voltage of a sensing line SL and a first reference voltage VREFH, and provides a first comparison signal to the OR element 18.

The second comparator 16 compares the voltage of the sensing line SL and a second reference voltage VREFL, and provides a second comparison signal to the OR element 18.

For example, the first and second reference voltages VREFH and VREFL may be set as threshold voltages of diodes. The first comparator 14 and the second comparator 16 may output a logic low signal by sensing that a voltage of the sensing line SL has a voltage variation width smaller than the threshold voltages of the diodes, and may output a logic high signal in the case where a voltage of the sensing line SL varies to be equal to or larger than the threshold voltages.

As another example, the first reference voltage VREFH and the second reference voltage VREFL may be set to levels smaller than the threshold voltages of the diodes. The voltage limiter 10 may sense a case where a voltage of the sensing line SL varies to be equal to or larger than the first reference voltage VREFH and the second reference voltage VREFL, which are set to the levels smaller than the threshold voltages of the diodes, and thereby, may output a reset signal. In this way, in the embodiment, the voltage limiter 10 may be configured to sense a voltage variation width smaller than the threshold voltages of the diodes. The OR element 18 may perform an OR logic function on the first and second comparison signals, and may output a reset signal SW_RST to a reset circuit 19.

The reset circuit 19 initializes the sensing line SL to a reset voltage in response to the reset signal SW_RST. The reset voltage may be set to a value equal or similar to an initial value before a sensing operation is started. For example, the reset circuit 19 may use a circuit and a reset voltage in the current-voltage converter 20.

The first and second comparators 14 and 16 enable the first comparison signal or the second comparison signal to a logic high in the case where a voltage of the sensing line SL goes out of the first reference voltage VREFH or the second reference voltage VREFL.

The OR element 18 enables the reset signal SW_RST to a logic high in response to the first comparison signal or the second comparison signal.

The reset circuit 19 may initialize the sensing line SL to the reset voltage in response to the reset signal SW_RST.

In this way, in the display driving device 100 including the voltage limiter 10, in the case where an overcurrent $I_{damage}$ flows due to a defect having occurred in a pixel of the display panel 200, the reset signal SW_RST may be enabled to initialize a voltage level of the sensing line SL to a value equal or similar to the initial value before the sensing operation is started.

Meanwhile, the display driving device 100 may include an internal voltage generation circuit (not illustrated) which generates the first and second reference voltages VREFH and VREFL. The internal voltage generation circuit may generate a plurality of internal voltages, and may select internal voltages, optimized for an operation of limiting a voltage variation among the internal voltages, as the first and second reference voltages VREFH and VREFL.

For example, the internal voltage generation circuit may select voltages, suitable for the characteristics of the display panel 200 among the plurality of internal voltages, as first and second reference voltages, by using a decoder, a voltage reference and a control signal such as a packet. The characteristics of the display panel 200 may include a normal voltage variation width of a sensing line according to characteristics such as threshold voltages and mobilities of pixels.

As is apparent from the above descriptions, in the display driving device 100 according to the embodiments, it is possible to minimize the influence of a bad pixel of the display panel 200 on sensing data of a normal channel by limiting an abrupt voltage variation due to an overcurrent having occurred in the bad pixel.

Also, in the display driving device 100 according to the embodiments, since normal compensation may be anticipated, performance in terms of image quality may be improved.

Further, in the display driving device 100 according to the embodiments, improvement in reliability or productivity may be anticipated by minimizing image quality degradation caused when a small number of bad pixels occur.

While various embodiments have been described above, it will be understood to those skilled in the art that the embodiments described are by way of example only. Accordingly, the disclosure described herein should not be limited based on the described embodiments.

What is claimed is:

1. A display driving device comprising:

sensing lines configured to sense pixel signals of a display panel; and a voltage limiter corresponding to each of the sensing lines, and configured to sense a voltage variation of the sensing line and limit a voltage level of the sensing line to a reference voltage, the voltage limiter comprising:

a first comparator configured to compare a voltage of the sensing line and a first reference voltage, and output a first comparison signal;

a second comparator configured to compare the voltage of the sensing line and a second reference voltage, and output a second comparison signal; and an operator configured to output a reset signal by performing a logic function on the first comparison signal and the second comparison signal.

2. The display driving device of claim 1, wherein the operator comprises an OR element.

3. The display driving device of claim 1, wherein the voltage limiter further comprises:

a reset circuit configured to initialize the sensing line to the reference voltage in response to the reset signal.

4. The display driving device of claim 3, wherein the voltage limiter outputs the reset signal in the case where a voltage of the sensing line varies to be equal to or larger than the first reference voltage or the second reference voltage.

5. The display driving device of claim 1, wherein the voltage limiter sets the first reference voltage and the second reference voltage to levels lower than threshold voltages of diodes so as to sense a voltage variation smaller than the threshold voltages of the diodes.

6. The display driving device of claim 1, further comprising:

an internal voltage generation circuit configured to generate a plurality of internal voltages, and provide the plurality of internal voltages to the voltage limiter, wherein at least one among the plurality of internal voltages is set as the first reference voltage and the second reference voltage.

7. The display driving device of claim 6, wherein the internal voltage generation circuit selects voltages, corresponding to characteristics of the display panel among the plurality of internal voltages, as the first reference voltage and the second reference voltage.

* * * * *